United States Patent [19]

Subotics et al.

[11] 4,403,776

[45] Sep. 13, 1983

[54] LOGIC TOY

[75] Inventors: Gyula Subotics; Gyulane Subotics, both of 52, Ferihegyi u., Budapest 1173; Lajos Nagy, 11, Jos u., Budapest 1036, all of Hungary

[73] Assignees: Gyula Subotics; Gyulane Subotics; Lajos Nagy, all of Budapest, Hungary

[21] Appl. No.: 257,920

[22] Filed: Apr. 27, 1981

[30] Foreign Application Priority Data

Apr. 25, 1980 [HU] Hungary ..... 1022

[51] Int. Cl.[3] ..... A63F 9/08

[52] U.S. Cl. ..... 273/153 R; 273/281

[58] Field of Search ..... 273/153 R, 155, 237, 273/281; 40/503, 504; 434/402, 404, 430, 431

[56] References Cited

U.S. PATENT DOCUMENTS

| | | | |
|---|---|---|---|
| 785,665 | 3/1905 | Coe | 273/153 S |
| 2,001,067 | 5/1935 | Lane | 273/153 R |
| 3,128,100 | 4/1964 | Sinden | 273/155 UX |
| 3,582,927 | 6/1971 | Primavera et al. | 434/430 |
| 4,062,546 | 12/1977 | McIntyre | 273/281 |
| 4,134,592 | 1/1979 | Pullman | 273/281 |

FOREIGN PATENT DOCUMENTS

| | | | |
|---|---|---|---|
| 374474 | 4/1923 | Fed. Rep. of Germany | 273/281 |
| 7638792 | 12/1976 | Fed. Rep. of Germany . | |
| 2848071 | 5/1979 | Fed. Rep. of Germany . | |
| 394052 | 12/1973 | U.S.S.R. | 434/402 |

*Primary Examiner*—Anton O. Oechsle

[57] ABSTRACT

A logic toy for distinctive indication of bordering zones on a surface, especially existing administrative districts, such as countries, facilitating herewith the development of logic way of thinking and depth perception together with the memorization of colored vision or other kind of signalling. The body of the logic toy is for example a parallelepiped, a sphere or globe or the like, the surface thereof is divided into separated zones, whereby the body is provided with built-in signalling means for displaying a signal simultaneously for each separated zone. Comparing the logic toy according to the invention to the known logic toys, such as the magic cube or the like, it means in each occasion a new logic task to be solved, therefore the playing can not become a routine work. Furthermore, a given task can be solved in different ways, and the tasks can be made gradually more and more complicated.

5 Claims, 11 Drawing Figures

LOGIC TOY

FIELD AND BACKGROUND OF THE INVENTION

The invention relates to a logic toy which can be used for distinctive indication of bordering zones on a surface, especially existing administrative districts such as countries, facilitating herewith the development of logic way of thinking and depth perception together with the memorization of coloured vision or other kind of signalling.

The toys of composing colours, known as magic cube of the like, have a common characteristic, namely, that the tasks, for example to set the elements in positions so that each surface be of a different colour, can be solved with a routine work.

SUMMARY OF THE INVENTION

The logic toy according to the present invention means on the contrary in each occasion a new task to be solved, that is, the tasks or problems can not be solved with a routine work.

On the top of it all, a given task can be solved in different ways, and the aim is that the player should find the solution requiring the least kinds of signals.

The point of interest of the toy according to the present invention is that—comparing to the colouring of a spherical or geographical map for example, where four different colours are sufficient for the signalling of the bordering zones, using always different colours—in the playing with the logic toy according to the invention it can be guaranteed that at least five signals, for example colours, could be used for an appropriate signalling.

The mode of playing can be made further complicated and more interesting by increasing the number of signals to be used.

The object of the present invention is, therefore, to provide a logic toy which can be used both alone and in groups as well, and which logic toy is different from the known logic toys, promotes the development of logic way of thinking and depth perception together with the memorization of colours and other signal combinations.

The logic toy according to the present invention can be used for organising competitions within smaller groups or in a whole country, by creating different types of games, for example by predetermining the signals of given zones in the beginning.

The object is accomplished according to the present invention by providing a logic toy, wherein the surface or surfaces of the body of the toy are of given shapes and are divided into separated zones, namely geometrical two-dimensional figures, wherein the surface or surfaces are provided with an aperture in each zone, and movable means, preferably disks are built in (for example fitted with bearing) by each aperture, and said movable means, preferably disks are independent from the apertures of the other zones.

The logic toy according to the present invention is specific in the respect that the surface or surfaces of the body of the logic toy are divided into zones of regular shape and/or irregular shape, wherein the body of the toy is provided with built-in signalling means serving for displaying in a given point of time one signal in each zone.

BRIEF DESCRIPTION OF THE DRAWINGS

The logic toy according to the present invention will be described in details by way of examples only, referring to the accompanying drawings, wherein.

DETAILED DESCRIPTION OF THE PREFERRED EMBODIMENTS

Figure 5:
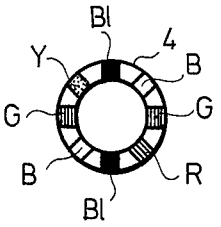
Figure 6:
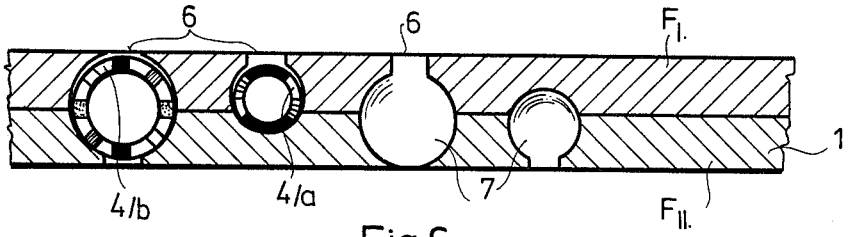
FIG. 6 is a cross-section of a body of the toy with apertures and disks.
Figure 7:
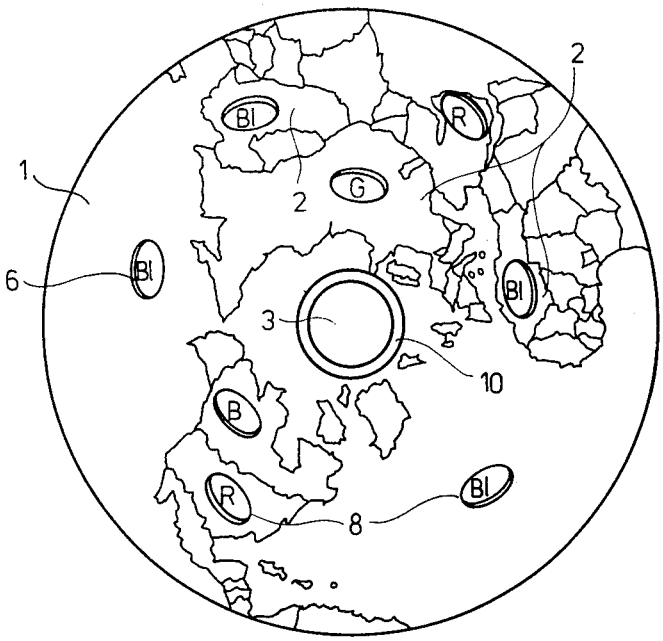
FIG. 7 shows a spherical body of toy.
Figure 8:
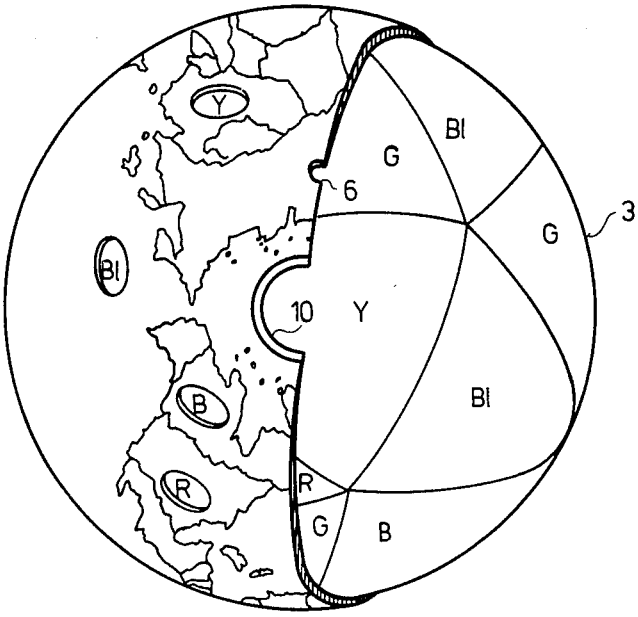
FIG. 8 shows a spherical body of toy, where the surface face is partly cut off in order to show the coloured surface placed thereunder.
Figure 9:
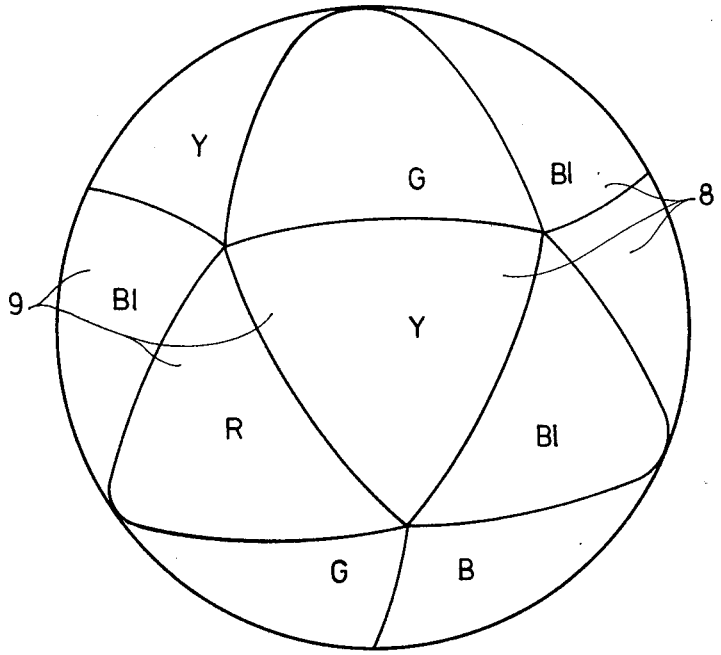
FIG. 9 is the view of a coloured spherical surface.
Figure 11:
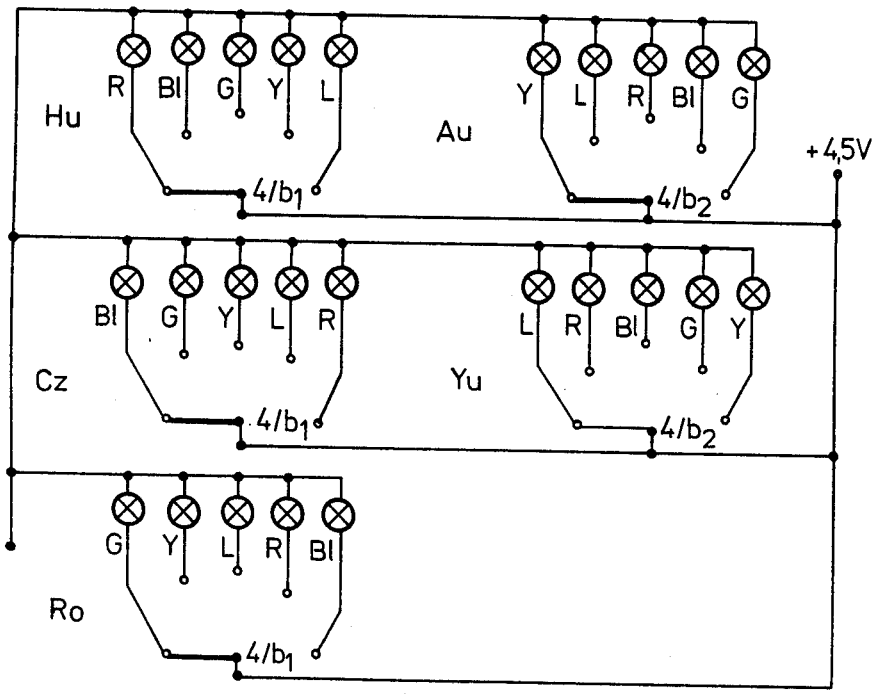
FIG. 11 is a circuit arrangement of an electric logic toy according to the invention.
Figure 10:
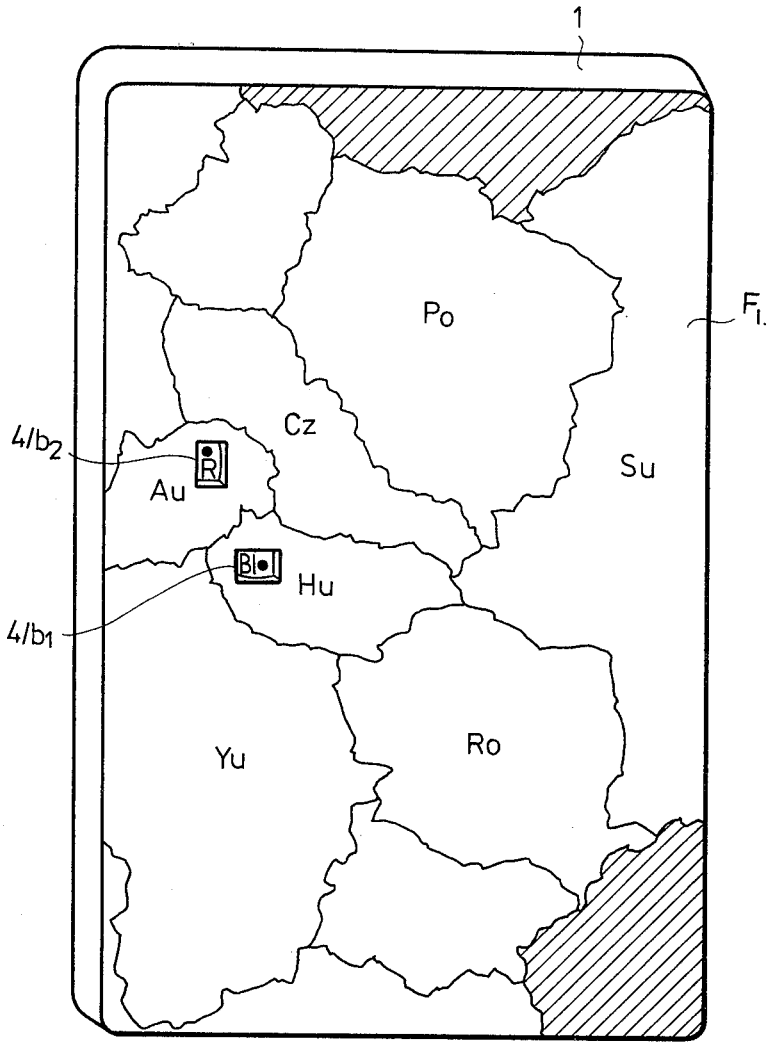
FIG. 10 shows one surface of a prismatic body of toy with electric displaying means and comprising two play surfaces.

One of the simplest embodiment of the logic toy according to the present invention is shown in FIGS. 1 to 6, another preferred embodiment, where the toy comprises a body of revolution, especially a sphere or globe, is shown in FIGS. 7 to 9, and finally the application of an electric displaying means is shown in FIGS. 10 and 11.

Figure 1:
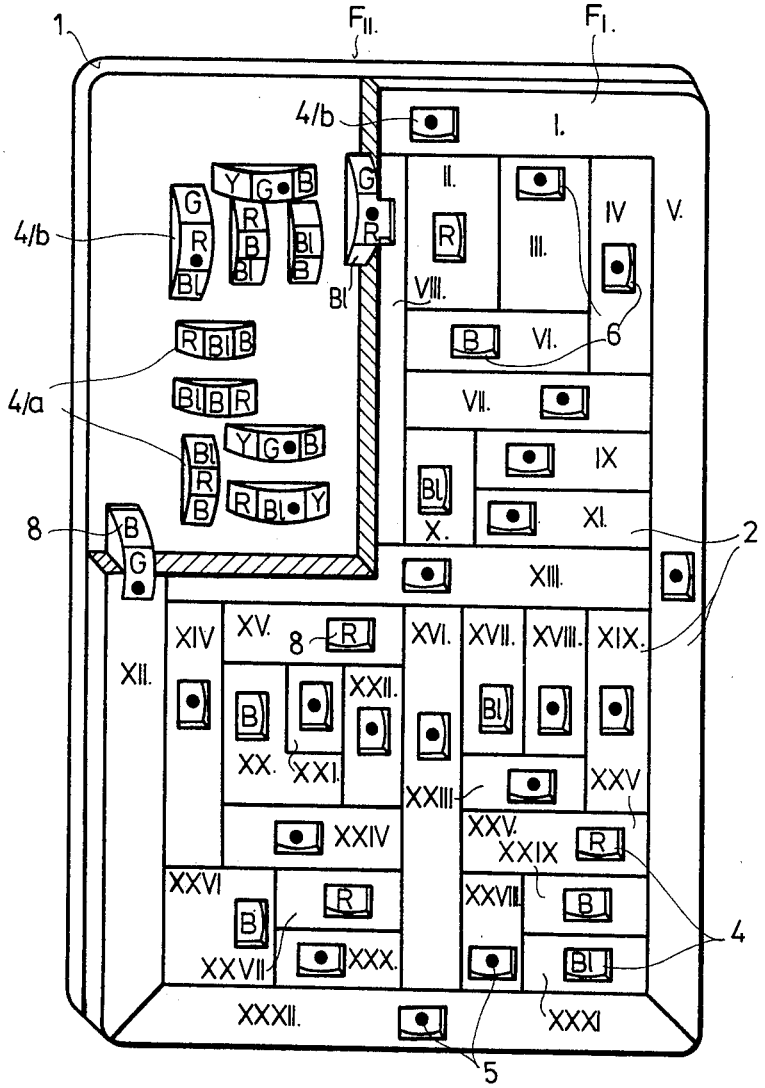
FIG. 1 is the perspective view of a prismatic body of toy, where the left upper quarter of one surface is cut out in order to better illustrate the disks with colour signals thereon.

Referring now to FIG. 1, a preferred embodiment of the logic toy according to the present invention comprises a prismatic body comprising a surface $F_I$ and a back surface $F_{II}$ (not shown in the Figure). Said surface $F_I$ is divided into separated zones 2 of various shapes and sizes, for example parallelpipeds and trapezoids I to LXIX.

Each separated zone 2 is provided with an aperture 6, in which signals 8 of built-in signalling means, such as disks 4, i.e. the initials of colours are visible, wherein the disks are for example fitted with bearing.

The disks 4 can be turned into other positions signalling another colour, at will.

The apertures 6 are positioned so that the signals of the coloured disks **4/*a* are visible only in one aperture, that is, in one zone only, and the signals of the coloured disks 4/*b*** are visible in more than one apertures or simultaneously in the aperture of one separated zone of both surfaces $F_I$ and $F_{II}$.

These signals may also be different.

Figure 2:
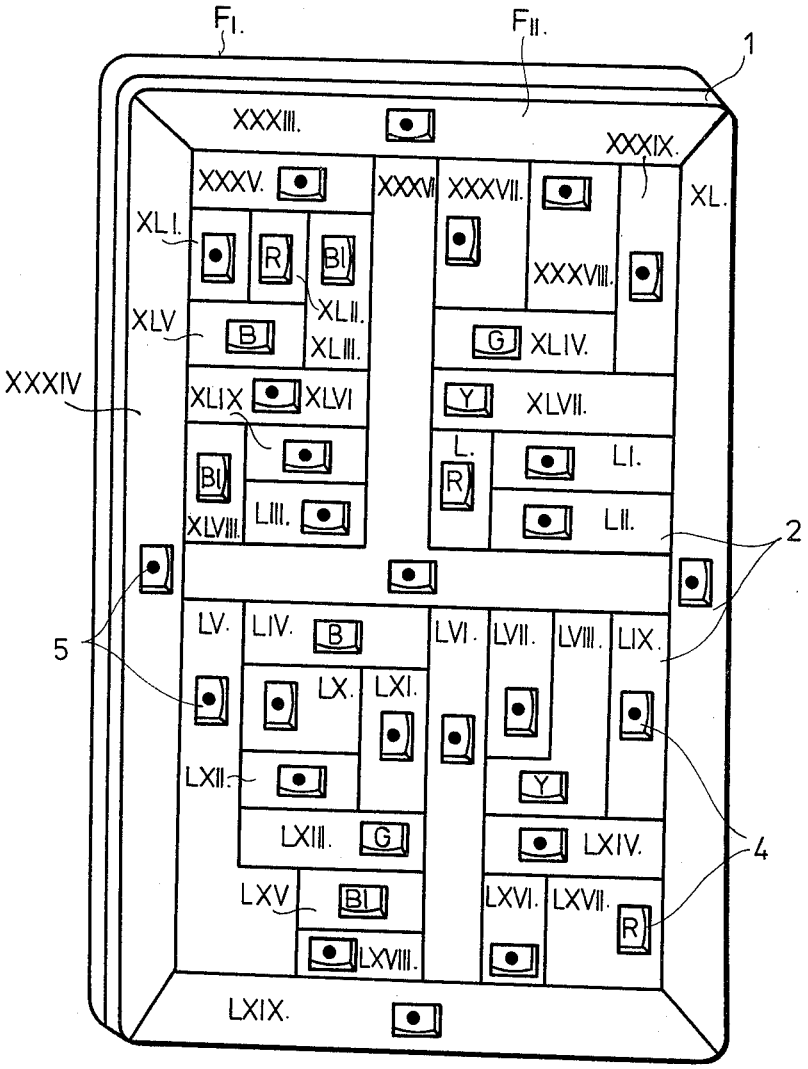
FIG. 2 is the perspective view of a prismatic body of toy showing another surface thereof.

Referring now to FIG. 2, the surface $F_{II}$ of the body 1 of the logic toy shown in FIG. 1 is illustrated here.

The disks **4/*b* provided with black dots 5** are visible in one aperture of both surfaces $F_I$ and $F_{II}$.

Figure 3:
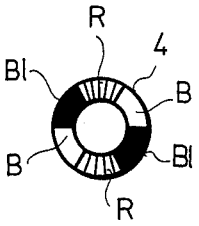
FIGS. 3 and 5 are side views of disks with colour signals applied in the body of the toy.

In FIG. 3 a coloured disk is shown, which is provided with red (R), black (B), blue (Bl), red (R), black (B) and blue (Bl) signals.

Figure 4:
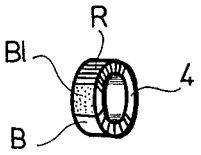
FIG. 4 is the perspective view of a disk with colour signals thereon.

In FIGS. 4 and 5 similar disks are shown, as in FIG. 3, which is provided however with other combinations of colours.

FIG. 6 is the cross-section of the body 1 of the logic toy according to the present invention, which is provided with holes 7, which contain the disks 4/*a* and 4/*b*, whereby said disks 4/*a* and 4/*b* are visible in the apertures 6.

According to another preferred embodiment of the present invention shown in FIGS. 7, 8 and 9, the body 1 of the logic toy is a body of revolution, for example a sphere or globe.

The colours are indicated in this embodiment on an internal colouring sphere 3, in the form of spherical triangles for example.

The colouring sphere 3 is placed inside the globe and the colours 8 thereof are visible in the apertures 6 belonging to the countries.

The globe is provided with apertures 10 on the North and South Poles through which the internal colouring sphere 3 can be turned.

In FIG. 10 a prismatic body 1 of the logic toy is demonstrated again, whereby both the illustrated surface $F_I$ and the back surface $F_{II}$ (here only signed) contain european countries, as an example, illustrated entirely or partly; Hungary (Hu), Roumania (Ro), Yugoslavia (Yu), Austria (Au), Czechoslovakia (Cz), Poland (Po), UdSSR (Su).

Both surfaces $F_I$ and $F_{II}$ of the body 1 of the logic toy are made of opaque glass or similar translucent material. In the example the signalling disk 4/$b_1$ is a 5-state 3-circuit switch, the signalling disk 4/$b_2$ is a 5-state 2-circuit switch, the switches 4/$b_1$ and 4/$b_2$ are used for illuminating the zones corresponding to two countries (Austria, Yugoslavia) and three countries (Hungary, Czechoslavakia, Roumania) respectively by means of colour electric bulbs placed under the opaque glasses.

The current source is supplied from a battery enclosed in the body 1 of the logic toy (not shown in the FIG. 9).

FIGS. 10 and 11 show the electric circuit of another preferred embodiment of the logic toy according to the invention, the colours of the applied electric bulbs are signed with the initials thereof: red with R, blue with Bl, green G, yellow Y and lilac L.

By means of the signalling switches 4/$b_1$ and 4/$b_2$ (for example Yaxley switches) the colours of two or three countries respectively are changed simultaneously, in accordance with Table I, as follows:

| | Switch position | | | | | |
|---|---|---|---|---|---|---|
| Country | 1 | 2 | 3 | 4 | 5 | Switch |
| Hu | R | Bl | G | Y | L | |
| Cz | Bl | G | Y | L | R | 4/$b_1$ |
| Ro | G | Y | L | R | Bl | |
| Au | Y | L | R | Bl | G | 4/$b_2$ |

-continued

| | Switch position | | | | | |
|---|---|---|---|---|---|---|
| Country | 1 | 2 | 3 | 4 | 5 | Switch |
| Yu | L | R | Bl | G | Y | |

The illumination of countries Hungary, Czehoslovakia and Roumania can be set by turning the signalling switch 4/$b_1$ so that the colour of Hungary be identical with the colour of the signalling switch 4/$b_1$ visible in the aperture, the colours of Czechoslovakia and Roumania be changed according to the programming (see Table I).

The case is the same with the signalling switch 4/$b_2$, but here Austria will have the same colour as the colour of the switch 4/$b_2$ visible in the aperture, and the colour of illumination of Yugoslavia depends also on the programming.

In the case, for example, when the programming corresponds to Table I, and the switches 4/$b_1$ and 4/$b_2$ are in the first position, the colours of illumination of the countries are as follows: Hungary is red, Czechoslovakia blue, Roumania green, Austria yellow and Yugoslavia lilac.

The colours of illumination of each country can be read in the Table I in a similar way, when the switches 4/$b_1$ and 4/$b_2$ are in another position.

What we claim is:

1. A logic toy for independently and distinctly signalling bordering zones designated on two oppositely lying logic game surfaces of a body (1) of said toy, each said surface ($F_1$, $F_{II}$) of said body (1) being divided into a plurality of separated zones (2), wherein said body (1) comprises a plurality of signalling means, predetermined ones (4/a) of said signalling means each serving an individual one of said zones only on one of said surfaces, predetermined ones of said signalling means each serving an individual one of said zones only on the oppositely lying surfaces, and predetermined other (4/b) of said signalling means serving more than one of said zones simultaneously, each one of said zones being served simultaneously lying on one of said opposite surfaces, said signalling means comprising switchable disks (4) provided with signals thereon, whereby displaying a different signal for adjacent zones lying on the same surface can be accomplished.

2. A logic toy as claimed in claim 1 characterized in that said body (1) of said logic toy is bordered by plane surfaces and the body (1) is a parallelpiped.

3. A logic toy as claimed in claim 2, characterised in that said separated zones (2) are of regular shape.

4. A logic toy as claimed in claim 1, characterized in that said surfaces ($F_I$, $F_{II}$) of said body (1) consist of separated zones (2) of irregular shape representing existing administrative districts, such as countries, lands, prefectures, or districts.

5. A logic toy as claimed in claim 1, characterized in that the signals (8) of said signalling means are colours, letters, or numerals.

* * * * *